US008203257B2

(12) United States Patent
Kuepper et al.

(10) Patent No.: US 8,203,257 B2
(45) Date of Patent: Jun. 19, 2012

(54) VEHICLE HEADLAMP THAT PRODUCES A LOWER INTENSITY LIGHT BEAM ABOVE THE LIGHT/DARK CUTOFF LINE

(75) Inventors: Lukas Kuepper, Aachen (DE); Albrecht Kraus, Kerkrade (NL); Benno Spinger, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 318 days.

(21) Appl. No.: 12/440,592

(22) PCT Filed: Sep. 10, 2007

(86) PCT No.: PCT/IB2007/053638

§ 371 (c)(1),
(2), (4) Date: Mar. 10, 2009

(87) PCT Pub. No.: WO2008/032258

PCT Pub. Date: Mar. 20, 2008

(65) Prior Publication Data

US 2010/0164350 A1 Jul. 1, 2010

(30) Foreign Application Priority Data

Sep. 13, 2006 (EP) ..... 06120559

(51) Int. Cl.

| | |
|---|---|
| ***H01J 5/16*** | (2006.01) |
| ***F21V 1/00*** | (2006.01) |
| ***F21V 9/00*** | (2006.01) |

(52) U.S. Cl. ..... 313/112; 313/117; 362/509; 362/293

(58) Field of Classification Search ..... None
See application file for complete search history.

(56) References Cited

U.S. PATENT DOCUMENTS

| | | | | |
|---|---|---|---|---|
| 1,990,666 | A * | 2/1935 | O'Loughlin | 362/256 |
| 3,136,914 | A * | 6/1964 | Foerst et al. | 313/117 |
| 4,029,985 | A * | 6/1977 | Rachel | 313/115 |
| 4,816,974 | A * | 3/1989 | Gordin | 362/261 |
| 4,868,726 | A | 9/1989 | Segoshi | |
| 5,111,105 | A | 5/1992 | Yamamoto | |
| 2002/0021065 | A1 * | 2/2002 | Gervelmeyer et al. | 313/112 |

FOREIGN PATENT DOCUMENTS

| | | | |
|---|---|---|---|
| DE | 1165748 | B | 3/1964 |
| DE | 1809958 | A1 | 7/1970 |
| DE | 10004701 | A1 | 8/2001 |
| EP | 0293959 | A2 | 12/1988 |
| EP | 1353361 | A2 | 10/2003 |
| GB | 328733 | A | 5/1930 |
| GB | 1581805 | A | 12/1980 |
| WO | 2004053924 | A2 | 6/2004 |

* cited by examiner

*Primary Examiner* — Toan Ton
*Assistant Examiner* — Britt D Hanley

(57) ABSTRACT

The invention relates to a lamp for motor vehicles that at least comprises a first incandescent filament that is intended to produce a light beam having a light/dark cutoff line, the incandescent filament having associated with it for this purpose a shielding cap to restrict the light emitted to a given angular range. The shielding cap (4) has at least one opening that is intended to produce a light beam above the light/dark cutoff line, with at least part of this light beam, which light beam passes through the said opening, not passing through and/or passing through a color filter.

9 Claims, 2 Drawing Sheets

VEHICLE HEADLAMP THAT PRODUCES A LOWER INTENSITY LIGHT BEAM ABOVE THE LIGHT/DARK CUTOFF LINE

The invention relates to a lamp for motor vehicles that at least comprises a first incandescent filament that is intended to produce a light beam having a light/dark cutoff line, the filament having associated with it for this purpose a shielding cap to restrict the light emitted to a given angular range.

The invention relates in particular to a lamp for a main headlamp of a motor vehicle, which lamp is fitted with two incandescent filaments of which one is produced without a shielding cap and enables a high beam to be produced. The other does have a shielding cap, to enable a low beam to be produced.

A lamp of this kind may in particular be a standardized lamp of the kind referred to as an "H4" lamp (or "HS1" lamp). Lamps of this type are currently used in vast numbers in high-beam/low-beam headlamps.

In certain countries, it is stipulated for road users, or is desirable, as a result of standards to this effect, that even in daylight the vehicle is only to be moved with its lights switched on.

For motorcycles, this is already widely the case and for cars it is becoming increasingly the case. As a result, the original reason for the introduction of this practice in the case of motorcycles is being negated, because even in daylight motorcycles are not then significantly different from automobiles as far as improved visibility is concerned.

To enable improved visibility to again be achieved, there are at the moment a number of possible solutions. To be approved for traffic on the public roads, these solutions need in particular to comply with the relevant European laws, rules and regulations and those of the United States of America.

All these solutions, such for example as the fitting of additional lighting elements, require additional space and involve additional expense. Also, additional energy has to be made available to power the additional lighting elements. Another regular requirement is also the expensive retrofitting of motorcycles, or rather their headlamp systems, that are already on the road at the moment.

There is also a requirement, particularly without the need for any major technical changes to be made to the lamp, for the lighting of the above-head region to be improved.

It is an object of the invention to provide a lamp that overcomes the above-mentioned disadvantages and that helps to improve safety on the roads. What is to be distinctive about this increased safety on the roads is an improved signal effect for oncoming traffic and/or improved lighting of the above-head region for the driver or rider. The lamp is also to be easy, in technological terms, to manufacture by industrial mass production.

The object of the invention is achieved by virtue of the features of claim 1. What is material to the invention in this case is that the shielding cap has at least one opening that is intended to produce a light beam above the light/dark cutoff line and that at least part of this light beam that passes through the said opening does not and/or does pass through a color filter.

The features material to the invention are claimed both in combination with one another and each separately.

What is achieved in this manner, in a surprisingly simple way, is significant visual distinctiveness for motorcycles in daylight. The solution is not, however, confined to motorcycles but is also able to be usefully employed, for example, for passenger cars and trucks.

This is achieved in the first place by the light beam of a different color that enters the field of vision of the oncoming traffic through the opening and the color filter. The sizing of the opening or openings and the color of a corresponding color filter are so selected that the relevant European laws, rules and regulations and those of the United States of America are in each case complied with.

Also, as an alternative or combination, by the use of one or more openings that are not combined with a color filter, a brief, defined "flashing" of the oncoming traffic is performed by the light beam that makes its way through the opening and into the road space occupied by the oncoming traffic.

In this case, the sizing of the opening or openings is performed in such a way that the relevant European laws, rules and regulations and those of the United States of America are in each case complied with. This relates to driving both in daylight and in darkness.

The subjects of the dependent claims are advantageous embodiments of the invention.

It is preferable for the color filter to have a light-absorbing capacity of at least 90%.

It is also preferable for the outline of the opening to be incorporated in the outline of the shielding cap. The outline of the opening may be of an approximately slotted form in this case, with the longitudinal axis of the said opening being arranged approximately parallel or perpendicularly to the longitudinal axis of the lamp. This makes it possible for the manufacture of a shielding cap having such an opening to be easy in technological terms.

The intensity of the light beam can be set by way of the width of the opening, and the distance of the strips of light in front of the vehicle can be set by way of the position of the opening relative to the low-beam filament.

A very wide opening (>1.5 mm) makes the strips of light less clearly defined, while a very narrow opening reduces visibility to the oncoming traffic.

For a first application, it is preferable for the opening to be so arranged that that part of the light beam that enters the road space above the light/dark cutoff line and in so doing does not pass through a color filter and/or does pass through a color filter, is directed onto the region of the eye-line of the oncoming traffic. What can be achieved with this arrangement is a particular signal effect for oncoming traffic.

For this first application, it is also preferable for the color filter to be a yellow filter, thus further reducing any dazzle or glare effect because yellow light is particularly suitable in this respect.

For a second application, it is preferable for the opening to be so arranged that that part of the light beam that enters the road space above the light/dark cutoff line and in so doing does not pass through a color filter and/or does pass through a color filter that is preferably a blue filter, is directed onto the region of the above-head traffic sign and road sign position. This makes it possible for a predetermined angular sector, such for example as the angular sector from approximately 12° to 138° in which traffic signs and road signs are arranged in the road space, to be able to be lit with blue filtered light in the glare region, i.e. above the light/dark cutoff line and above the eye-line.

This is achieved without the oncoming traffic being dazzled. Lighting with blue light is generally preferred in this case, because it significantly increases the visibility of objects in the above-head region to the driver.

The above-head region is situated approximately at least 1.8 m above the level of the roadway.

These and other aspects of the invention are apparent from and will be elucidated with reference to the embodiments described hereinafter, without the scope of the invention being limited to these embodiments.

Figure 1:
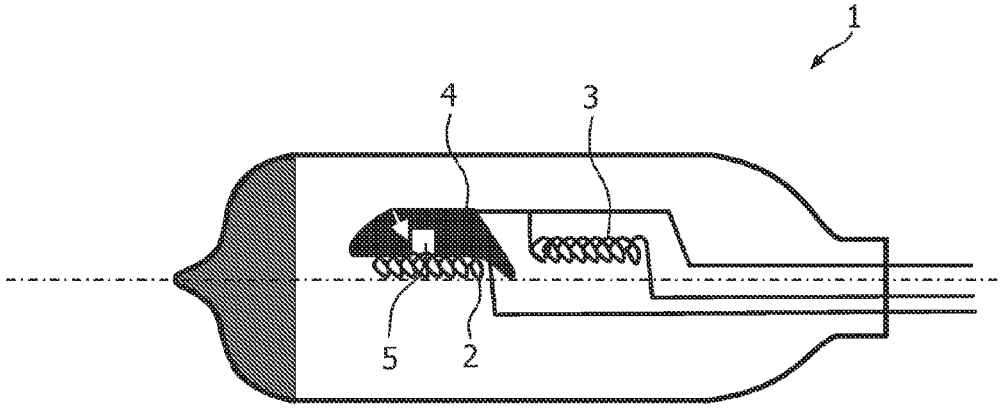
FIG. 1 is a schematic view from the side of a first embodiment of a twin-filament halogen incandescent lamp.

The first preferred embodiment of the invention that is shown in a schematic view from the side in FIG. 1 is a twin-filament halogen incandescent lamp that is intended for use in a motor vehicle main headlamp.

This lamp has a substantially cylindrical glass lamp envelope 1 containing two incandescent filaments 2, 3 that are arranged in the usual way approximately parallel to the longitudinal axis of the lamp (shown as a dotted and dashed line in FIG. 1). The incandescent filament 2 that is used to produce the low-beam light has a shielding cap 4 to restrict the radiant light to a predetermined angular range in a known fashion.

What are used to hold the two incandescent filaments 2, 3 in position and to supply power to them are three power supply means that project from the region of the pinch seal of the lamp envelope 1. The shielding cap 4 partly masks off the incandescent filament 2.

Incorporated in the outline of the shielding cap 4, which is otherwise normal in configuration, is an opening 5. The outline of the opening 5 is approximately slotted in form, i.e. is of an approximately rectangular shape, with a width of approximately 0.5 mm and a length of approximately 2.5 mm. When the lamp is viewed, the opening 5 is situated at 90° to the inverted burning position, i.e. its longitudinal axis is approximately perpendicular to the longitudinal axis of the lamp. The opening 5 is situated approximately centrally and opposite the central region of the incandescent filament 2. The incandescent filament 2 is approximately 5 mm long and its diameter is approximately 1.3 mm.

Figure 2:
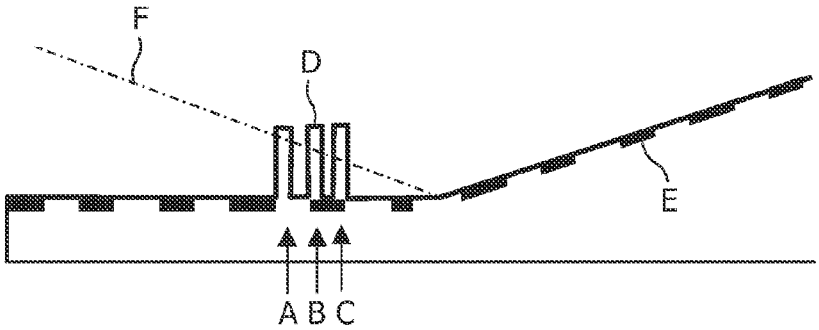
FIG. 2 is a schematic view of the pattern of light distribution from a twin-filament halogen incandescent lamp as shown in FIG. 1 when operating on low beam.

FIG. 2 is a schematic view of the pattern of light distribution from a twin-filament halogen incandescent lamp as shown in FIG. 1 when operating on low beam. What is shown is a schematic representation of the road space projected onto a single plane.

The opening 5, as shown in FIG. 1, in the shielding cap produces, in the light beam from the headlamp that makes its way into the road space, the pattern of light distribution shown in the drawing. The opening 5 acts like a pinhole camera in this case: the low-beam filament, i.e. the incandescent filament 2 is mapped along the light/dark cutoff line D (represented in FIG. 2 by a solid line) by the slotted opening 5. (To make clear the difference from a conventional shielding cap, i.e. one not having the opening according to the invention, the light/dark cutoff line E of the latter is indicated by a dashed line in FIG. 2.) The eyes of an oncoming driver or rider (the oncoming traffic) move along the eye-line F (shown in FIG. 2 as a dotted and dashed line) that extends obliquely upwards.

At the three points A, B and C, which are situated approximately 30 m, 60 m and 80 m in front of the vehicle having the lamp according to the invention, the eyes of the oncoming drivers or riders travel through the light beam from the lamp according to the invention in succession on the respective distances being reached, and at each point experience a brief flash of light that, due to the short time of exposure and the low intensity (less than 2,000 cd), does not produce any glare or dazzle effect and thus does not have any adverse effect on safety on the road.

The intensity of this light beam can be set by way of the width of the opening and the distance of the lighted strips in front of the vehicle can be set via the position of the opening relative to the low-beam filament.

A very wide opening (>1.5 mm) produces unsharp lighted strips that merge into one another, while a very narrow opening produces lighted strips that are sharply separated from one another but whose visibility to oncoming traffic is appreciably reduced due to the low intensity of the light.

Figure 3:
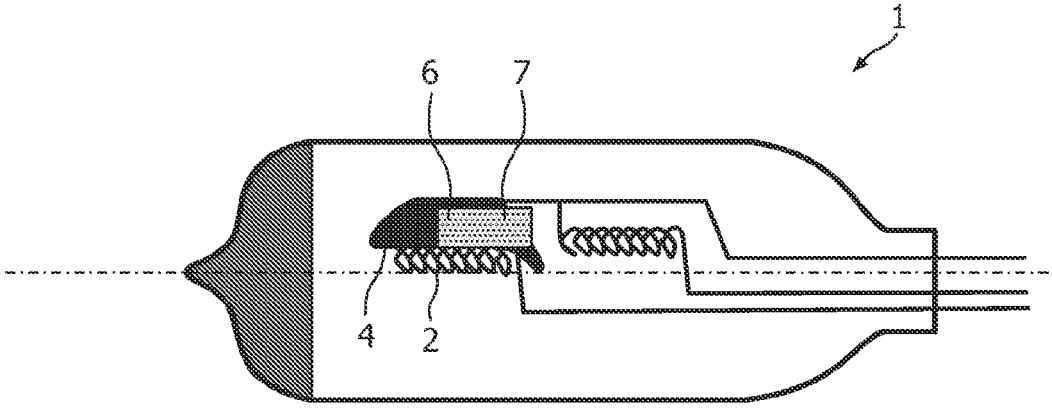
FIG. 3 is a schematic view from the side of a second embodiment of a twin-filament halogen incandescent lamp.

The second preferred embodiment of the invention that is shown in a schematic view from the side in FIG. 3 is a twin-filament halogen incandescent lamp. Except for the opening in the shielding cap and a blue filtering coating, the lamp is similar in construction to the lamp shown in FIG. 1. The blue filtering coating 7 is arranged on the outside of the lamp envelope 1. The opening 6 is so arranged that that part of the light beam that enters the road space above the light/dark cutoff line and in so doing passes through the color filter 7, is directed onto the region of the above-head traffic sign and road sign position.

The opening 6, or rather its longitudinal axis, extends in the shielding cap 4 approximately parallel to the longitudinal axis of the incandescent filament 2 (shown in FIG. 3 as a dotted and dashed line). Relative to its longitudinal axis, the opening 6 is approximately 2.3 mm long and approximately 2 mm wide. When operating on low beam, the opening 6 produces, in the headlamp beam from the lamp, the pattern of distribution of light shown in FIG. 4. In the glare region, i.e. above the light/dark cutoff line and above the eye-line F (shown in FIG. 4 as a dotted and dashed line), the road space is lit with blue filtered light over the angular sector from approximately 12° to 138°. It is in this region of the traffic that overhead traffic signs and road signs are typically situated. The light transmission of the blue filtering coating 7 is approximately 5% in this case.

Figure 4:
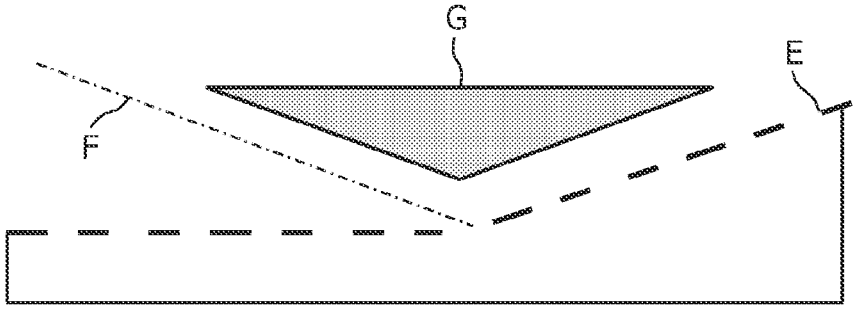
FIG. 4 is a schematic view of the pattern of light distribution from a twin-filament halogen incandescent lamp as shown in FIG. 3 when operating on low beam.

FIG. 4 is a schematic view of the pattern of light distribution from a twin-filament halogen incandescent lamp as shown in FIG. 3 when operating on low beam. What is shown is a schematic view of the road space.

In the glare region G, i.e. the region that is shown as a triangular area above the light/dark cutoff line E (shown as a dashed line in FIG. 4) and above the eye-line F (shown as a dotted and dashed line in FIG. 4), the road space is lit with blue filtered light over the angular sector extending from approximately 12° to 138° (which is shown only schematically and not exactly in FIG. 4).

This makes it possible for objects that are situated in what is termed the above-head region, i.e. are at least approximately 1.8 m above the level of the roadway, to be more satisfactorily illuminated. This is achieved without the oncoming traffic being dazzled. Illumination with blue light is generally preferred in this case because this significantly increases the visibility to the driver of objects in the above-head region.

The invention claimed is:

1. A lamp for motor vehicles comprising:

a first incandescent filament (2) that is intended to produce light beams above and below a light/dark cutoff line, the incandescent filament (2) having associated with it for this purpose a shielding cap (4) to restrict the light emitted to a given angular range, characterized in that the shielding cap (4) has at least one opening that is intended to produce a light beam above the light/dark cutoff line of a lower intensity than the light beam produced below the light/dark cutoff line, and the light beam, which passes through the said opening, passes through a color filter.

2. A lamp as claimed in claim 1, characterized in that the color filter has a light-absorbing capacity of at least 90%.

3. A lamp as claimed in claim 1, characterized in that the color filter is arranged on the lamp envelope.

4. A lamp as claimed in claim 1, characterized in that the outline of the opening is incorporated in the outline of the shielding cap (4), and is situated approximately centrally and opposite the central region of the first incandescent filament 2.

5. A lamp as claimed in claim 1, characterized in that the outline of the opening is of an approximately slotted form, with the longitudinal axis of the said opening being arranged approximately parallel or perpendicularly to the longitudinal axis of the lamp.

6. A lamp as claimed in claim 1, characterized in that the opening is so arranged that that part of the light beam that enters the road space above the light/dark cutoff line and in so doing passes through a color filter, is directed onto the region of the eye-line of the oncoming traffic.

7. A lamp as claimed in claim 6, characterized in that the color filter is a yellow filter.

8. A lamp as claimed in claim 1, characterized in that the opening is so arranged that that part of the light beam that enters the road space above the light/dark cutoff line and in so doing passes through a color filter, is directed onto the region of the above-head traffic sign and road sign position.

9. A lamp as claimed in claim 8, characterized in that the color filter is a blue filter.

* * * * *